United States Patent [19]

Walker, Jr.

[11] 3,936,051

[45] Feb. 3, 1976

[54] TETHERED-BALL GAME HAVING SUSPENDED RECEIVING MEANS

[76] Inventor: Wilmer David Walker, Jr., 1316 Sharon St. NW., Atlanta, Ga. 30314

[22] Filed: Oct. 18, 1974

[21] Appl. No.: 515,985

[52] U.S. Cl. ..... 273/95 A; 273/DIG. 19

[51] Int. Cl.[2] ..... A63B 71/02

[58] Field of Search.... 273/95 A, 97 R, 98, DIG. 19

[56] References Cited

UNITED STATES PATENTS

| | | | |
|---|---|---|---|
| 3,110,497 | 11/1963 | Broman | 273/DIG. 19 |
| 3,471,154 | 10/1969 | Saunders | 273/DIG. 19 |
| 3,656,747 | 4/1972 | Revell | 273/95 A |
| 3,685,827 | 8/1972 | Petrusek | 273/97 R |
| 3,747,929 | 7/1973 | Burke | 273/95 A |
| 3,774,910 | 11/1973 | Walker | 273/95 A |
| 3,820,783 | 6/1974 | Caveness | 273/1.5 A |

*Primary Examiner*—Richard C. Pinkham
*Assistant Examiner*—Marvin Siskind
*Attorney, Agent, or Firm*—Jones, Thomas & Askew

[57] ABSTRACT

A tethered-ball game having a receptacles suspended between two players, or between one player and a stationary object, and a tossing member carried at the end of a tether, the tether being fixed to the receptacles.

1 Claim, 3 Drawing Figures

TETHERED-BALL GAME HAVING SUSPENDED RECEIVING MEANS

This invention relates to a tethered-ball game, and is more particularly concerned with a cup and tethered ball game wherein the cup is flexibly suspended from one or more players.

In the past, numerous tethered-ball or hip-toss games have been devised, these games normally taking the form of a substantaially rigid member attachable substantially to the hip region of a player and providing a tethered ball that is to be placed either within a cup or through a hole in one of the hip-mounted devices. The hip-toss games are normally characterized by a relatively freely movable tethered ball and a relatively rigid receiving member for the ball, the receiving member being relatively rigidly fixed to the hips of a player. With such an arrangement, the receiving member is relatively easily manipulable by a player so that such a game might be easily learned and quickly forgotten.

Unlike the prior art tethered-ball games, the game of the present invention comprises a receiving member that is flexibly suspended between two points, one or both of which may be the hip region or other area of a player, and a ball or other tossing member that is tethered to the receiving member. With this arrangement, it will be understood that neither the tossing member nor the receiving member is easily manipulable by a player since the receiving member is flexibly carried by one or more players and the tossing member is flexibly carried by the receiving member; therefore, great skill is required to manipulate the tossing member in proper fashion to place the tossing member into the receiving member. Further, the game can be made even more difficult through the use of one stationary object and one player for suspension of the receiving member which restricts the ability to manipulate the receiving member.

These and other features and advantages of the present invention will become apparent from consideration of the following specification when taken in conjunction with the accompanying drawings in which.

Figure 1:
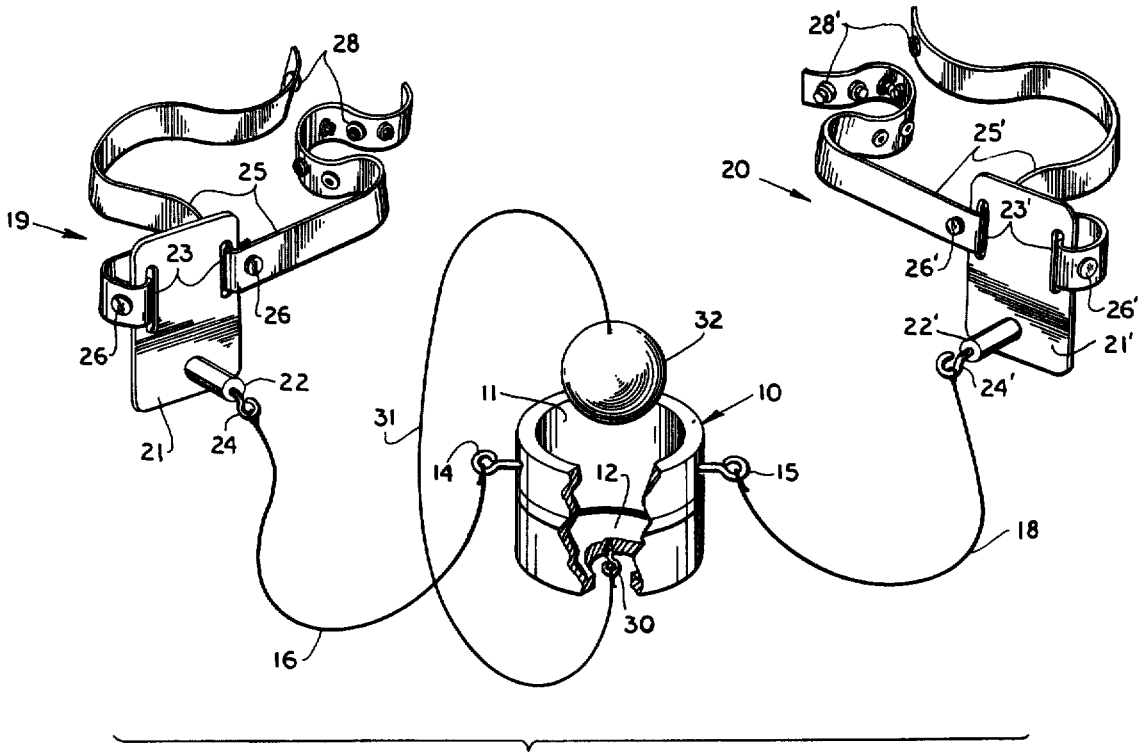
FIG. 1 is a perspective view, partially broken away, illustrating one form of apparatus made in accordance with the present invention.

Referring now more particularly to the drawings, and to that embodiment of the invention here chosen by way of illustration, it will be seen in FIG. 1 that the apparatus includes a receiving member 10 that is substantially cylindrical. The receiving member 10 comprises generally a cup including a side wall 11 and a bottom 12. Affixed to the side wall 11 is a pair of eyelets 14 and 15. The eyelets 14 and 15 are here shown as substantially diametrically opposed to each other, and each eyelet 14 and 15 receives a suspension line such as the lines 16 and 18.

Each of the suspension lines 16 and 18 has its opposite end connected to a harness 19 or 20. The harnesses 19 and 20 are substantially identical so only the harness 19 will be described in detail, and the same numerals with primes added will be applied to the harness 20.

The harness 19 includes a belly plate 21 having a boss 22 affixed thereto. The boss 22 terminates in a ring 24 which receives the suspension line 16. At each opposite side of the belly plate 21, there is a slot 23 to receive a strap 25. The strap 25 passes through the slot 23 and is secured to the belly plate 21 by a brad 26 or the like. The straps 25 are long enough to reach around a player, e.g. around a player's hips, and the extending ends of the straps 25 are provided with snaps or other fasteners 28. Preferably, as here illustrated, there is a plurality of the fasteners 28, the arrangement being such that the straps 25 can be fastened together at any of a pluarlity of different effective lengths.

Returning now to receiving member 10, it will be seen that the bottom 12 of the receiving member 10 has an eye 30 secured thereto, the eye 30 receiving a flexible tether 31; and, the opposite end of the tether 31 carries the tossing member 32.

Though the tossing member 32 may be made of virtually any material, it is contemplated that the tossing member will be a rather elastic ball so that the tossing member 32 can bounce off the wall 11 of the receiving member 10 during play. Alternatively, however, the tossing member 32 may be quite soft and inelastic, especially if the game is to be played by very young people. If the tossing member 32 is relatively inelastic, the game will be easier to play since the tossing member 32 will tend not to bounce off the wall 11 of the receiving member 10, but will tend to fall into the receiving member 10 more easily.

Figure 2:
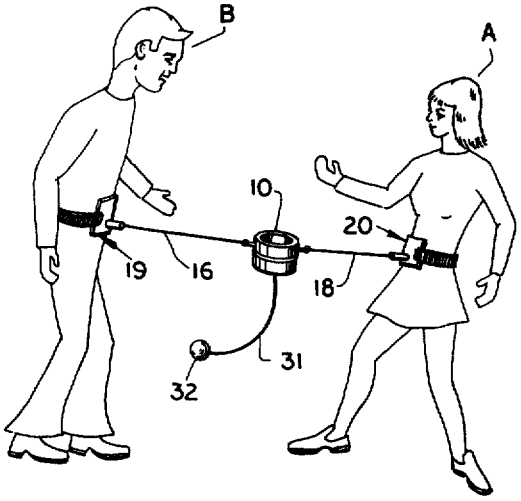
FIG. 2 is an illustration of the device shown in FIG. 1 being utilized with two players; and, FIG. 3 is an illustration of the device shown in FIG. 1 being used by a single player.

Referring now to FIG. 2 of the drawing, it will be seen that two players, here designated as A and B, have the harnesses 19 and 20 respectively secured about their hip regions with the belly plates 21 and 21', respectively, substantially at the lower abdomen of the players. The receiving member 10 is suspended between the players A and B by means of the suspension lines 16 and 18. Since the suspension lines 16 and 18 are flexible, it will be understood that the receiving member 10 is very unstable between the players A and B unless the players A and B move away from each other sufficiently that the suspension lines 16 and 18 are relatively taut; however, it will be understood that when the suspension lines 16 and 18 are relatively taut, the possible motion of the receiving member 10 is quite limited. In order to cause some motion of the receiving member 10, it will generally be necessary for the players A and B to move towards each other somewhat so that the suspension lines 16 and 18 become somewhat slack. In this position, the receiving member 10 can be caused to swing, and swinging of the receiving member 10 will cause the tossing member 32 to swing at the end of its tether 31. Both the tossing member 32 and the receiving member 10 are therefore almost constantly in motion so that great skill will be required to bring the tossing member 32 and the receiving member 10 together so that the tossing member 32 will be received within the receiving member 10. At an appropriate time, the players A and B might move away from each other to render the suspension lines 16 and 18 relatively taut. By such a maneuver, the receiving member 10 can perhaps be placed underneath the tossing member 32 after the tossing member 32 has been manipulated to elevate it sufficiently to be above the receiving member 10.

Figure 3:
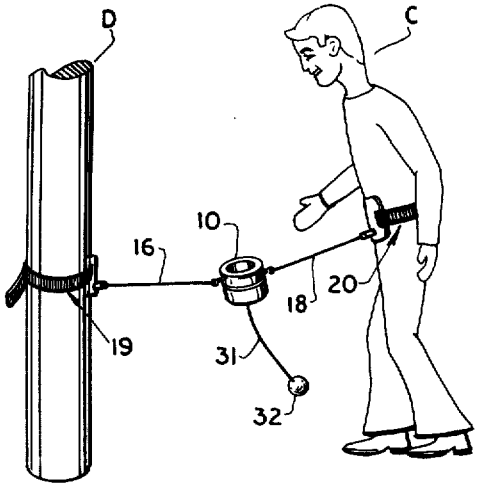

The use of the game as shown in FIG. 3 of the drawings utilizes only one player designated at C in conjunction with a fixed member designated at D. The fixed member D is here shown as a post, and for such a member the harness 19 can quite simply be placed around the post D in a manner similar to that previously described for a person. It should also be understood that other substantially stationary objects might be used in lieu of the post D, including such items as door knobs and the like.

With a stationary object such as the post D to receive the harness 19, it will be seen that the suspension line 16 cannot be manipulated to assist in playing the game; therefore, the player C will have to create all of the motion of the receiving member 10 and the suspended tossing member 32.

From the foregoing description it should be understood that numerous variations can be made in the apparatus herein disclosed to make the game either easier or more difficult to play. It will be seen that the stability of the cup that comprises the receiving member 10 depends on the placement of the eyelets 14 and 15 as well as the weight of the cup. By selection of the desired weight and location of eyelets the receiving member 10 may be very stable, or almost freely rotatable. Also, the lengths of the suspension lines 16 and 18 will affect the stability of the receiving member 10, and make the receiving member 10 more or less difficult to control.

While the receiving member 10 is herein illustrated as cylindrical, it could easily be of any other desired shape, and the tossing member could remain spherical or could also be of some other shape. The tether 31 can be fixed to other portions of the receiving member 10 if desired, and the tether 31 can be lengthened or shortened for variety in the game.

Thus, the game of the present invention is quite versatile, having numerous easily exchanged parts that can be altered as desired to fit the particular players. The rules of a game to be played are also variable in that either one or two players can use the game, and the game can be scored on the basis of the time required for a player to put the tossing member into the receiving member or on the basis of the number of "catches" within a given playing time.

Therefore, it will be understood that numerous changes and modifications may be made in the embodiment of the invention here chosen by way of illustration without departing from the spirit or scope of the present invention as defined by the appended claims.

I claim:

1. A tethered-ball game apparatus wherein two players are required to cooperate to achieve the object of the game, said apparatus including a receiving member comprising a cup having side walls and a bottom, a tossing member comprising a ball of such size as to be receivable within said receiving means, suspension means for suspending said receiving member between said two players, said suspension means comprising a first flexible suspension line having one of its ends fixed to one side of said receiving member above the center of gravity of said receiving member and the other of its ends releasibly fixed to one of said players, and a second flexible suspension line having one of its ends fixed to the opposite side of said receiving member above the center of gravity of said receiving member and the other of its ends releasibly fixed to the other of said players, and a flexible tether, one end of said flexible tether being fixed to said bottom of said receiving member, said tossing member being carried at the opposite end of said flexible tether, said flexible tether and said tossing member being so constructed and arranged that said tossing member will assume a pendulum-like motion upon swinging of said receiving member on said first suspension line and said second suspension line.

* * * * *